United States Patent [19]

Schürch

[11] Patent Number: 4,672,697

[45] Date of Patent: Jun. 16, 1987

[54] TILTING EXERCISE BED ACTUATED BY A LINEAR ELECTROMECHANICAL DEVICE

[76] Inventor: Ernesto Schürch, Via Ionio 21, Battipaglia, Italy

[21] Appl. No.: 791,463

[22] Filed: Oct. 25, 1985

[30] Foreign Application Priority Data

Oct. 25, 1984 [IT] Italy ..... 49067 A/84

[51] Int. Cl.[4] ..... A61G 7/00; A47C 21/00; B65H 1/00

[52] U.S. Cl. ..... 5/62; 5/509; 5/510; 5/511; 272/144; 272/145; 269/323; 269/325

[58] Field of Search ..... 5/62, 61, 60, 81 R, 5/509, 510, 511; 272/144, 145; 74/105; 269/323, 325

[56] References Cited

U.S. PATENT DOCUMENTS

| | | | |
|---|---|---|---|
| 882,641 | 3/1908 | Joslin | 5/61 |
| 920,500 | 5/1909 | Thomas | 5/62 |
| 3,200,416 | 8/1965 | Warrick | 5/62 |
| 3,348,893 | 10/1967 | Katzfey et al. | 5/465 |
| 4,019,772 | 4/1977 | Lee | 5/81 B |
| 4,071,916 | 2/1978 | Nelson | 5/62 |
| 4,099,277 | 7/1978 | Watkins | 5/62 |

FOREIGN PATENT DOCUMENTS

| | | | |
|---|---|---|---|
| 2257202 | 5/1974 | Fed. Rep. of Germany | 5/81 |
| 2552488 | 10/1977 | Fed. Rep. of Germany | 5/61 |
| 3021559 | 12/1981 | Fed. Rep. of Germany | 5/60 |
| 917188 | 1/1963 | United Kingdom | 5/509 |

*Primary Examiner*—Thomas J. Holko
*Assistant Examiner*—Carl M. DeFranco, Jr.
*Attorney, Agent, or Firm*—Wigman & Cohen

[57] ABSTRACT

A frame for holding a body which lies thereon is pivoted on a transverse horizontal axis supported by a couple of vertical parallel uprights, on one of which a fixed electrical device having a rectilinear vertical stroke is provided. The remote controlled driver causes its push rod to move up and down, said push rod being connected with a slider that moves along the uprights.

A connection rod is hinged to the slider at one end, and to the frame at the other end, so as to cause the rotation of the frame through an arch in clockwise or counterclockwise direction, depending on slider motion direction.

4 Claims, 10 Drawing Figures

TILTING EXERCISE BED ACTUATED BY A LINEAR ELECTROMECHANICAL DEVICE

FIELD OF THE INVENTION

The present invention relates to a tilting bed, to make a body lying thereon assume a desired position sloping with respect to the horizontal. This invention can find effective appliances in several therapies, in physical culture, in aesthetics, and can be an useful instrument to reach a well staying.

BACKGROUND OF THE INVENTION

Several devices which can be driven by means of the physical force of the user have been and are still employed, said devices allowing, for instance, to turn a body upside-down. With regard to this, the Italian Patent No. 974271 describes, among other things, a gymnastic device substantially comprising a couple of uprights provided with means to fasten athlete's feet to it, and a frame, to support throughout the athlete, this frame being pivoted sidewise in said uprights so as to be able to turn one round angle. The athlete, after placing himself on the frame and after fastening himself thereto, can turn upside-down, chaning his barycentre by moving his arms.

Such an exercise promotes, among other things, the musculature restoration and aids to maintain a sound constitution. This device involves a certain physical force and can be used by those who have such an athletic ability that already makes them accomplish satisfactory performances.

SUMMARY OF THE INVENTION

The author of the present invention, believing it useful a device of the above mentioned kind, has made a tilting bed, according to claims, said bed being able to operate both by means of the physical force of the user, and by means of an electromechanical device. In both cases, the result that could be obtained, is to make the user lying on this bed slowly assume a continuous succession of tilted positions, and therefore also a substantially reverse position, namely head downwards, and feet upwards.

The advantages coming from staying in this latter position are various. First, a back-bone relaxation can be observed, useful to prevent very common diseases, such as back-ache, pains in the joints, slight rheumatism. The reverse position of the body carried out without making use of the tilting bed according to the present invention, but, for instance, by means of the yoga technique, causes the head to be loaded with the body weight, so resulting in a back-bone compression, that could block the blood circulation in some points of the body.

On the contrary, with the bed according to the present invention, the bloodstream is promoted, with remarkable advantages, especially in hypotensive subjects: a greater blood flow towards and backwards the brain, with a perfectly controlled tilting and not so fast as it is caused by known gymnastic devices, improves blood circulation, increasing therefore the power of concentration and decreasing headache occurence. An improved blood circulation allows the solution of other connected problems, so as, for instance, states of depression depending on climate conditions, venous valve efficiency hindering blood reflux therefore causing varices in the legs, and gives an advantageous result, especially for face skin.

On the other hand, the physical exercises that by means of the bed can be performed, can promote musculature restoration, in particular with respect to abdominal and dorsal muscles, together with connected advantages, such as a recovery of a correct erect position, an improvement of respiratory and physiological functions, and generally a physical and psychical well-being, also due to the stimulation of glandes normalizing the vital functions. It is furthermore evident that the tilting bed according to the present invention can be useful in those therapies for which several kinds, comparatively complicated, of beds able to place a subject in a tilted position, are already known, it could be employed in radiology, in laser therapy, in physiotherapy, in orthopaedy, and also in various traction therapies, for which counterweights systems can be easily used and for various rehabilitation therapies, a.s.o.

This tilting bed may be employed like a common examination-bed that additionally allows the patient to get on it easily and to be then moved to a horizontal position, to undergo a medical examination. This is particularly useful to those who have some troubles in getting on a common bed. With respect to similar known beds, it has the advantage who consists in a comparatively low price, connected, as a result, of an optimized project and design, which lets presume a diffusion also for private use.

BRIEF DESCRIPTION OF THE DRAWINGS

The advantages and the distinctive features of the invention will be more evident from the following description of the two embodiments, together with the annexed drawings, wherein.

DETAILED DESCRIPTION OF THE DRAWINGS OF THE INVENTION

Figure 1:
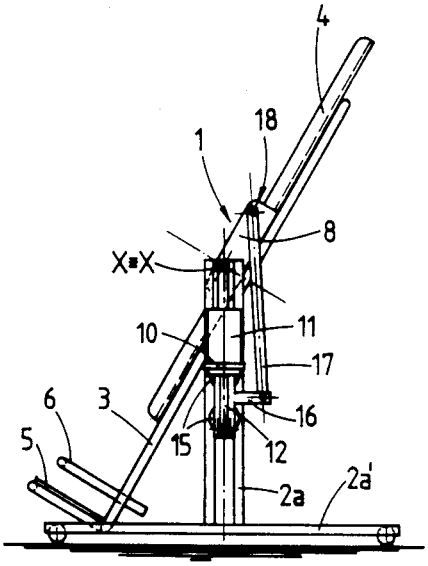
FIG. 1 is a side elevation view of one embodiment of a tilting bed according to the invention, in a start position, in which, for more clearness, the cover of the electromechanical device is removed.
Figure 2:
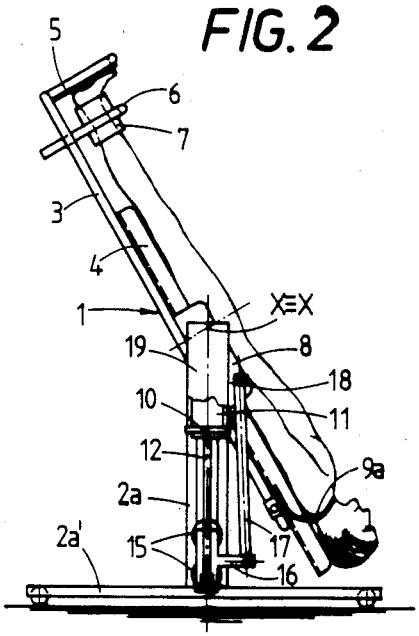
FIG. 2 is a view similar to the preceding one, showing a person secured to the bed and in a reverse position.

Referring to the FIGS. 1 to 4, reference number 1 relates to a tilting bed as a whole, supported by couples of vertical parallel uprights 2*a* and 2*b*. Bed 1 comprises a tubular substantially rectangular frame 3 to which a table 4 is fastened, said table 4 being suitably stuffed and covered to allow a person to lie comfortably thereon. At one end of the frame 3 an orthogonal extractable footrest plate 5 is set, and near to it, a bar 6 adjustable longitudinally and in height with respect to the tubular frame 3. Bar 6 allows known means 7 to be fixed thereto, said means 7 being intended to hold patient's ankles. Frame 3 is centrally pivoted at symmetrically opposite positions, so as to be able to rotate around X—X horizontal axis on bearings mounted on the couples of uprights 2*a* and 2*b* respectively. Near uprights 2*a*, on tubular frame 3 a longitudinal plate 8 is fastened projecting upwardly in a vertical plane. Near the front end of frame 3 are adjustable round supports 9*a*, 9*b* for holding patient's shoulders.

Figure 5:
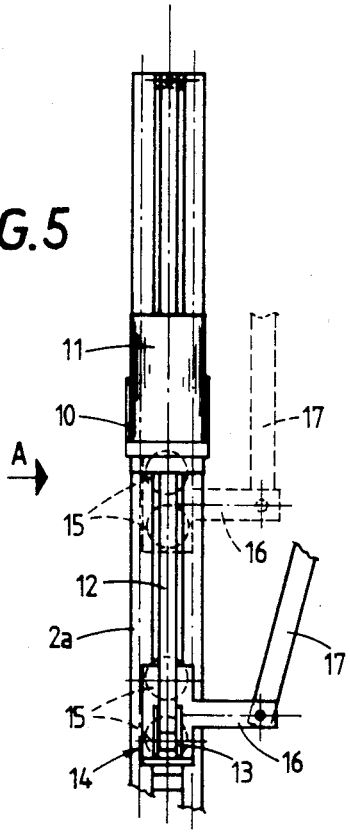
FIG. 5 is a side view in enlarged scale of the electromechanical device.
Figure 6:
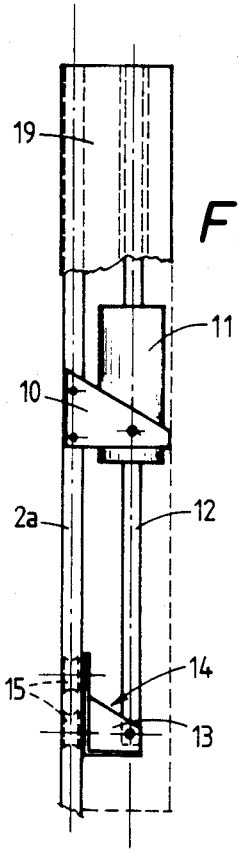
FIG. 6 is a view in direction of arrow A of FIG. 5.

Each couple of uprights 2*a* and 2*b*, connected each other by transverse bars (not shown) comprises two tubular vertical parallel elements, facing each other and assembled one to the other by means of distance elements; each couple of uprights 2*a* and 2*b* is secured to a horizontal base rod 2*a'*, 2*b'* preferably provided with wheels. On uprights 2*a*, in a suitable position, by means of a support 10, a linear electrical device 11 (as better seen in FIGS. 5 and 6) is mounted. The push rod of this latter, in its lower end is connected with a vertical rib 13 of a L-shaped bracket 14, on the vertical part of bracket 14 at least two wheels 15 being pivotally connected, said wheels 15 having a race conjugated with respect to the corresponding cross section of tubular uprights 2*a* vertical part.

As can be seen in Figures, for instance, tubular uprights 2*a* have round cross section, and the race of wheels 15 is accordingly concave. Between uprights 2*a*, one or two slide members (not shown) may move, instead of wheels 15, but having more friction.

Bracket 14 together with wheels 15 or together with slide members form therefore a slide, and uprights 2*a* vertical portions form its guide.

An arm 16 is fixed to bracket 14, said arm 16 projecting sidewise at the front of the bed. At the free end of arm 16 a removable connection bar 17, for instance by means of an extractable pivot provided with a knob 18, is pivotally connected with the above mentioned plate 8 of frame 3. Thus, push rod 12, bracket 14, connection bar 17 and frame 3 together form an articulated quadrilateral.

The electromechanical device, that needs only a small space is closed in a cover 19, defining sidewise a slit to make arm 16 passes therethrough. Linear electrical device 11 is chosen, among those on the market, so as to have such a push rod stroke to allow desired bed rotation, i.e. about 120°, from the position shown in FIG. 1 to the position shown in FIG. 2, with a desired angular velocity subordinate to push rod translation velocity, which is a few cm/s. The electrical device is also provided with automatic end of stroke. The electrical device may be placed also at the other side of the bed if it is required. We are coming now to outline the possible functions of the bed. User places himself on the bed when it is in the tilted position shown in FIG. 1, he secures his ankles directly to the stretcher or, in case, by means of suitable means fastened to the footrest plate, and he also secures his shoulders to the round supports, which are suitably adjustable like all the other holding members. Then, the user himself, but the aid of another person would be advisable, will actuate the electrical device, that in turn will move downwardly its push rod, and consequently also the slider it is connected with. Connection bar will carry out the bed downward rotation (clockwise in the drawings), so as to assume the position shown in FIG. 2. When it is desired, rotation direction may be reversed, by making the push rod enter the electrical device again. If a shutting off of electrical power occurs, or when it is desired to carry out the operation of the bed without actuating the electromechanical device, it is possible to disconnect quickly the connection bar, by removing its locking pivot from bed plate.

Figure 3:
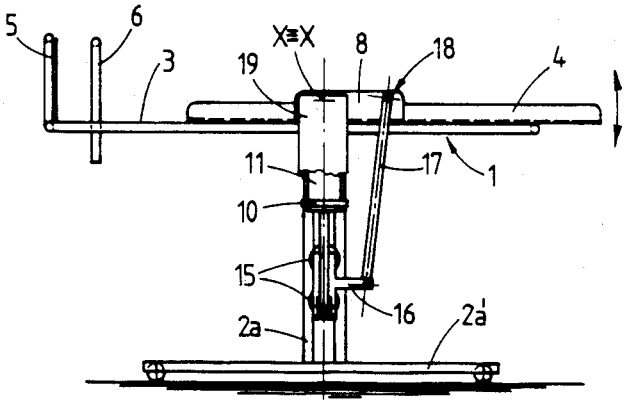
FIG. 3 is a view similar to the preceding ones, showing the bed in a horizontal position.
Figure 4:
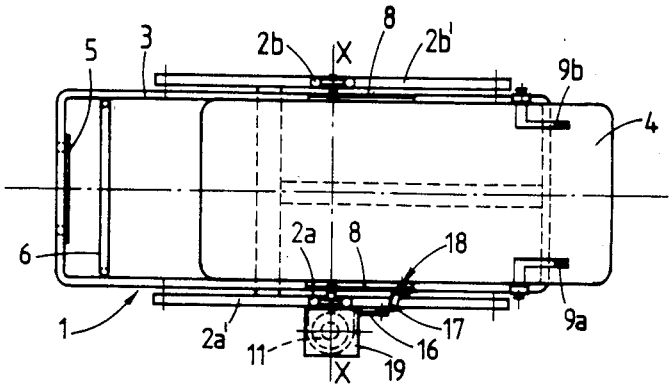
FIG. 4 is a top plan view of the bed of FIG. 1.

If the tilting bed is employed as an examination table and therefore it is commonly intended to assume a horizontal position, means for holding the patient lying thereon may be eliminated, and the bed table may be lenghtened to the footrest plate. (FIG. 3).

Figure 7:
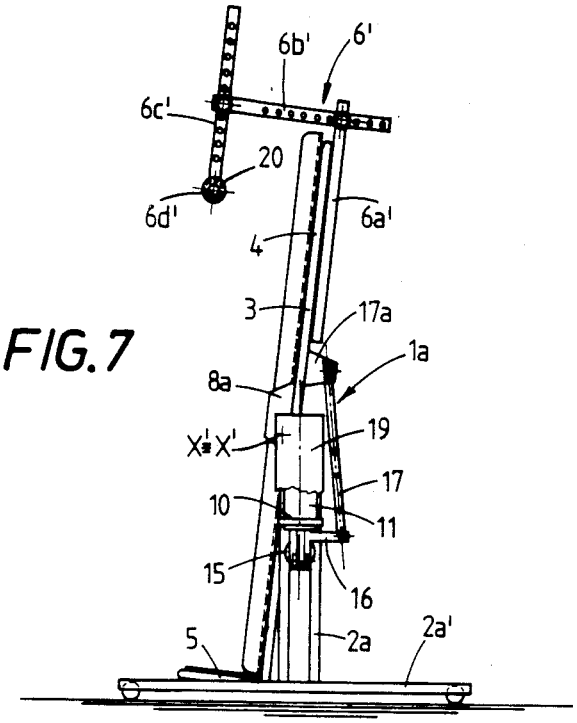
FIG. 7 is a side elevation view of a second embodiment of the tilting bed, in one of its extreme tilted positions.

In another embodiment of the bed according to the invention (FIGS. 7, 8, 9, 10), wherein to make its description easier unvaried parts are marked with the same reference numbers of the preceding figures, the axis X'—X' of rotation of the bed 1*a* and pivot 18*a* of rigid connection bar 17, said pivot being on plate 17*a*, have such positions to allow the bed to assume an extreme substantially vertical tilt (FIG. 7). Furthermore, the carrying structure 6' of the holding ankle member 6*d'* has a different shape, as it will be shown hereinbelow, and it is placed, with respect to the preceding embodiment, at the opposite end of the bed. This is in order to carry out those rehabilitation therapies requiring the patient to be holded upside-down, or fastened to the thorax with free hanging legs. Said patient will be placed on the bed when it is in a horizontal position, and then the bed will be slowly moved to the extreme vertical tilt of FIG. 7. Instead, if the bed of FIGS. 7, 8, 9, 10 will be employed for common medical examinations for those patients who have some motion troubles, said patients will have to get on the bed when it is in the position of FIG. 7, with their feet put on plate 5, and then the bed will be moved to a horizontal position.

Figure 8:
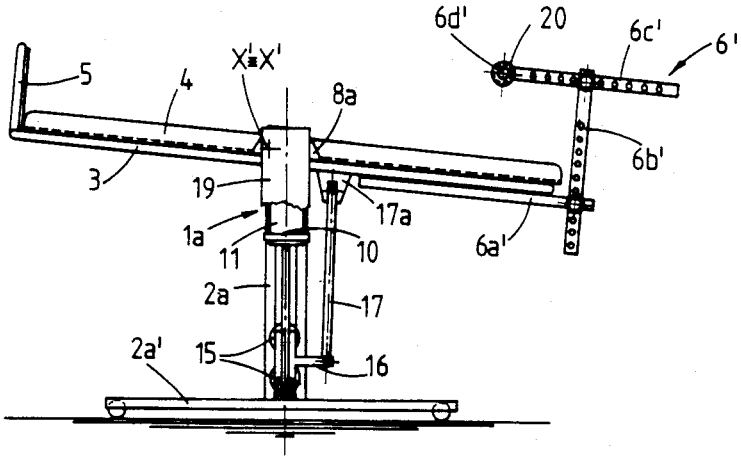
FIG. 8 is a view similar to the preceding one, showing the bed in its other extreme tilted position.
Figure 9:
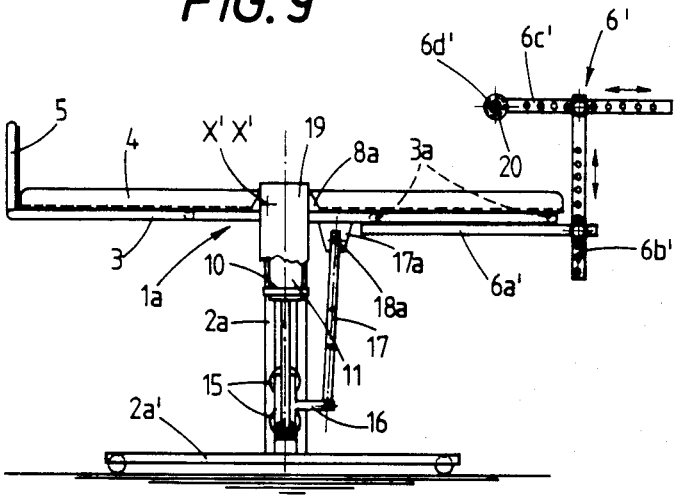
FIG. 9 is a view similar to the two preceding ones, showing the bed in a horizontal position.
Figure 10:
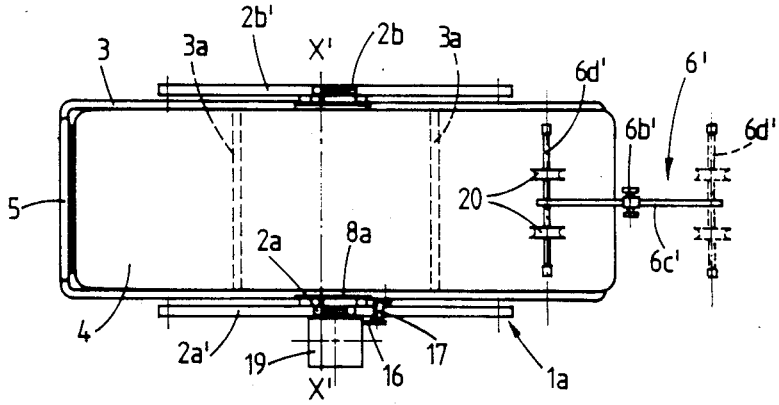
FIG. 10 is a top plan view of the bed of FIG. 7.

In FIG. 8 the bed is in its other extreme tilt, said tilt being about 5° clockwise with respect to the horizontal, so the whole arch of rotation of this second embodiment is asymmetric with respect to the horizontal.

The carrying structure 6' of the holding ankle member 6*d'* comprises a horizontal rod 6*a'* fastened to bed cross bars 3*a*, a vertical bar 6*b'* provided with holes for its adjustable fastening to rod 6*a'*, another horizontal bar 6*c'* provided with holes for its adjustment along the longitudinal direction of the bed, so as to allow a right set up of the holding ankle member 6*d'*, fastened to bar 6*c'* crosswise with respect to the longitudinal direction of the bed.

Holding ankle members 7 may be fixed to member 6*d'*, in said member 6*d'* two pulleys 20 being also inserted to carry out, in case, a so called traction therapy with weights. Finally, in this second embodiment, the bed-plate 4 covers the whole lenght of the frame 3.

What I claim is:

1. A tilting bed for a patient performing physical therapies, such as muscular restoration, in particular with respect to abdominal and dorsal muscles, comprising:

a frame supporting a padded plate to receive the patient, said frame being pivotally supported for tilting about a transverse center tilting axis of said bed by two pairs of opposed stationary supporting uprights, the uprights of each pair being vertically and parallelly spaced apart from one another, and being parallel to a longitudinal center plane of the bed, so as to define therebetween a vertical sliding race, the tilting of said frame with the padded plate being performed by an electromechanical device, wherein the electromechanical device comprises:

an electrical actuator having a vertically reciprocating sliding rod, said rod being moved up and down by said actuator, said actuator being fixedly mounted on the outer side of one pair of the uprights, near the upper ends of said one pair of the uprights;

a vertically sliding bracket member, comprising a wheeled bracket having a horizontal L-shaped cross section and having two vertical flanges, one of said flanges being disposed perpendicular to the longitudinal center plane of the bed and the other of said flanges carrying parallel horizontal shafts of at least two wheels slidably mounted in said sliding race defined between the uprights, said bracket being connected to the lower end of the reciprocating sliding rod of the actuator; and a connecting bar pivotally connected at its lower end to the other flange of the bracket, said other flange of the bracket being disposed parallel to the longitudinal center plane of the bed, the upper end of the bar being pivotally connected at a corresponding side of the frame, at a point spaced apart from the tilting axis of said frame by such distance so as to cause the frame with the padded plate to be rotatable about said tilting axis of the frame by an angle of about 120° with respect of the stationary pairs of supporting uprights.

2. A tilting bed, according to claim 1, wherein each pair of uprights are made integral at their lower end with a base foot being adapted to be mounted on wheels.

3. A tilting bed, according to claim 1, further comprising a pivot pin which pivotally connects the upper end of the connecting bar to the frame, wherein said pivot pin is removably mounted, in order to permit selective deactivation of the electromechanical device so as to enable the patient to perform the tilting movements in an active manner.

4. A tilting bed, according to claim 1, wherein means to hold the patient's ankles are provided, mounted near the foot end of the frame, as well as a height adjustable plate, while other ankle holding means are provided near the head end of the bed adapted to support the patient in an upside-down position.

* * * * *